US006116956A

United States Patent [19]

Wu

[11] Patent Number: 6,116,956

[45] Date of Patent: Sep. 12, 2000

[54] ELECTRICAL CONNECTOR FOR A POWER SUPPLY

[76] Inventor: Kun-Tsan Wu, 930 W. Maude Ave., Sunnyvale, Calif. 94086

[21] Appl. No.: 08/844,400

[22] Filed: Apr. 18, 1997

[30] Foreign Application Priority Data

| | | | |
|---|---|---|---|
| Apr. 19, 1996 | [TW] | Taiwan | 85205620 |
| Apr. 19, 1996 | [TW] | Taiwan | 85205621 |
| Apr. 19, 1996 | [TW] | Taiwan | 85205622 |

[51] Int. Cl.[7] ..... H01R 17/00

[52] U.S. Cl. ..... 439/626; 439/862

[58] Field of Search ..... 439/660, 626, 439/862, 637

[56] References Cited

U.S. PATENT DOCUMENTS

| | | | |
|---|---|---|---|
| 3,101,231 | 8/1963 | Klostermann | 439/567 |
| 5,137,454 | 8/1992 | Baechtle | 439/637 |
| 5,336,111 | 8/1994 | Thrush et al. | 439/567 |
| 5,613,877 | 3/1997 | Patel et al. | 439/567 |
| 5,727,968 | 3/1998 | Ito | 439/459 |
| 5,785,556 | 7/1998 | Pratt et al. | 439/637 |
| 5,785,557 | 7/1998 | Davis | 439/660 |

*Primary Examiner*—Neil Abrams
*Assistant Examiner*—J. F. Duverne

[57] ABSTRACT

An electrical connector for a power supply and a conductive contact for such an electrical connector are disclosed. The electrical connector comprises a main body and a plurality of conductive contacts received in a plurality of grooves on the main body. Each of the grooves comprise a raised portion, a supporting surface adjacent to the raised portion, and a channel communicating the groove to an exterior of the main body. Each of the conductive contact comprises a retaining section, an inserting section, and a deflecting section. A number of retention pieces of the retaining section of the contact are insert in a number of slits provided on a retaining portion of the raised portion and a pivoting portion of the deflecting section abuts on a pivoting surface of the raised portion so that a supporting portion of the deflecting does not abut to the supporting surface of the groove until the conductive connector engages with a mating connector. Also, a pair of fixing posts may be formed integrally with the main body for fixing to an external printed circuit board.

10 Claims, 7 Drawing Sheets

ELECTRICAL CONNECTOR FOR A POWER SUPPLY

FIELD OF THE INVENTION

The present invention relates to an electrical connector, more particularly to an electrical connector for a power supply which provides reliable electrical connection with a mating connector.

BACKGROUND OF THE INVENTION

Recently, rechargeable batteries have become a main power supply system for various portable electrical apparatus, such as portable cameras, movable telephones and portable computers, and electrical connectors for rechargeable batteries become more and more important due to the wide use of such batteries.

A conventional electrical connector for a battery is disclosed in Taiwan Patent Application No. 82103837 and the corresponding U.S. Pat. No. 5,470,255. This electrical connector includes a plurality of conductive contacts of an N-shaped configuration. In practical use, because batteries are repeatedly detached from the apparatus for recharging, and inserted back thereto, the N-shaped conductive contacts in these batteries are liable to deform and lose resilience thereof due to repeated uses. Finally the conductive contact can no longer provide enough engaging force at the contact point, causing sudden power interruption of the apparatus. In addition, these portable apparatus especially are often used in a vibration situation. If a low engaging force is provided by an electrical contact, for example, an N-shaped conductive contact being used for a long while, power supplying would be unstable and intermittent in such a vibration situation.

Other conventional devices for fixing an electrical connector onto a printed circuit board can also be found in Taiwan Patent Application No. 82103837 and the corresponding U.S. Pat. No. 5,470,255. In these conventional devices, a pair of metal fixing pieces are provided between an electrical connector and a printed circuit board to connect the former to the latter. In assembling, one end of the fixing pieces is secured to an insulating housing by a rivet or by integral barbs formed on the fixing pieces, and the other end is inserted into a positioning hole in the board. These metal fixing pieces, however, increase material cost of a connector because more components (the fixing pieces themselves) are used in a connector, and thus increase the assembling cost due to long assembling time, and moreover, the inventory cost. The increasing cost decreases the competition ability of a connector.

Hence, there is a need for an electrical connector for a power supply which provides reliable electrical connection with a mating connector when used repeatedly especially in a vibration situation.

Still further, there is a need for an electrical connector for a power supply which provides reliable electrical connection with a mating connector which possesses simple structure and is easy to manufacture.

SUMMARY OF THE INVENTION

One object of the present invention is to provide an electrical connector for a power supply which can be repeatedly detached from an electrical apparatus for recharging and inserted back thereto for many times yet keeps reliable electrical connection with a mating connector.

Another object of the present invention is to provide an electrical connector for a power supply which provides reliable electrical connection with a mating connector, even used in a vibration situation.

Still another object of the present invention is to provide an electrical connector for a power supply which possesses simple structure and is easy to manufacture.

One more object of the present invention is to provide a conductive contact for an electrical connector which may be incorporated into an electrical connector to provide a durable engaging ability for the connector.

To fulfill the above-mentioned objects, according to one embodiment of the present invention, an electrical connector for a power supply comprises a main body, a plurality of conductive contacts received in a plurality of grooves on the main body. Each of the grooves comprise a raised portion, a supporting surface adjacent to the raised portion, and a channel communicating the groove to an exterior of the main body. Each of the conductive contact comprises a retaining section, an inserting section, and a deflecting section. A number of retention pieces provided on the retaining section of the contact are inserted in a number of slits provided on a retaining portion of the raised portion and a pivoting portion of the deflecting section abuts on a pivoting surface of the raised portion so that a supporting portion of the deflecting section does not abut to the supporting surface of the groove until the conductive connector engages with a mating connector.

According to another embodiment of the present invention, an electrical connector for a power supply comprises a main body receiving at lease one conductive contact and a pair of fixing posts integrally formed on the main body. Each of the fixing posts has an elongate aperture so as to provide a space allowing an inward movement of a lateral side of the fixing post adjacent to the aperture when an urging force exerts on the lateral side.

According to still another embodiment of the present invention, a conductive contact for an electrical connector comprises a retaining section for retaining on a main body of an electrical connector, a inserting section for connection with an external printed circuit board, and a deflecting section. The deflecting section has a pivoting portion and an arcuate engagement portion such that a moment arm defined by a length of the pivoting portion and the arcuate engagement portion is variable in length while in use.

These and additional objects, features, and advantages of the present invention will be apparent from a reading of the following detailed description of the embodiments of the invention taken in conjunction with the appended drawing figures, which are described briefly immediately below.

DETAILED DESCRIPTION OF THE PREFERRED EMBODIMENT(S)

Figure 1:
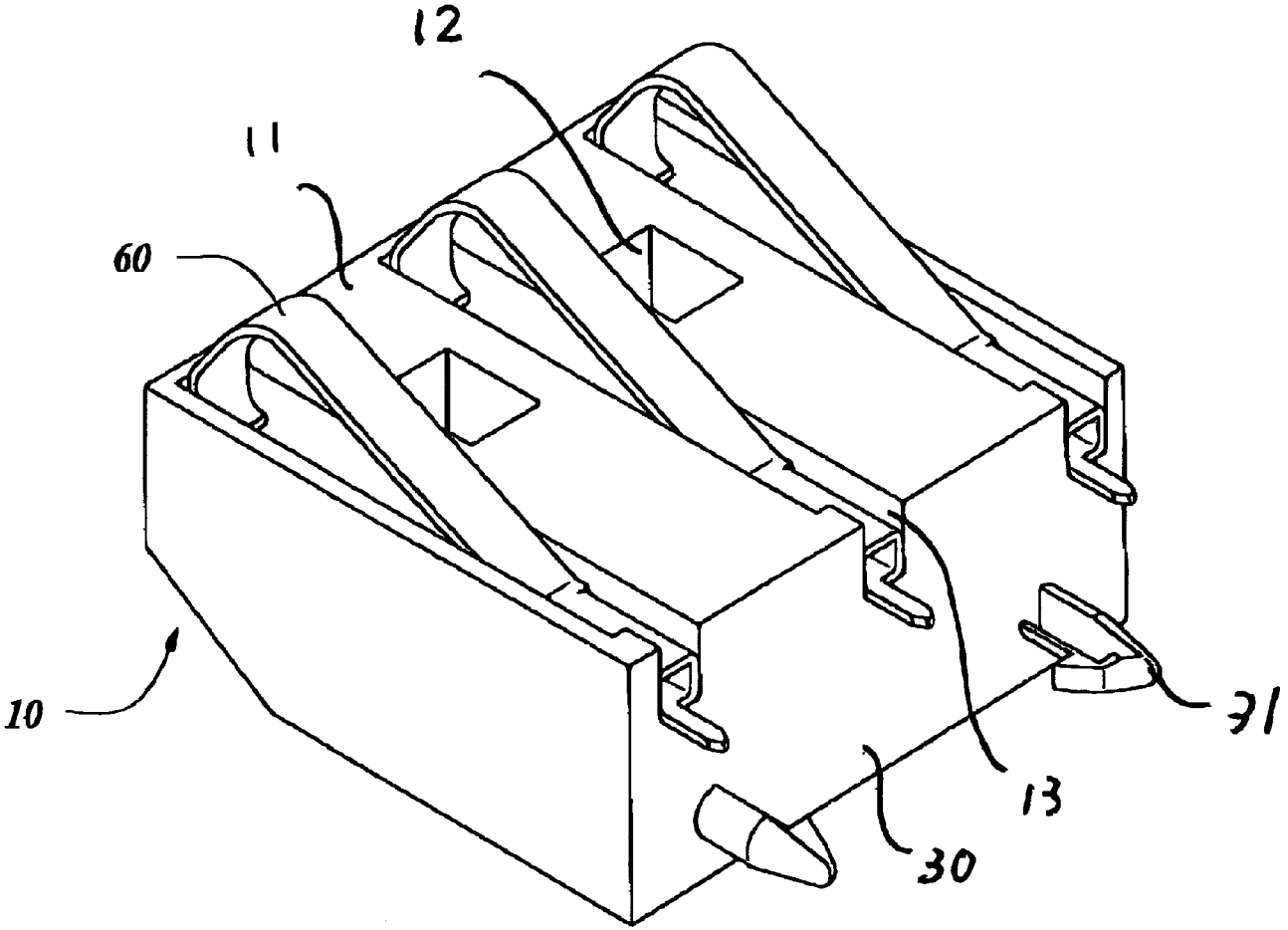
FIG. 1 is a perspective view of an electrical connector for a power supply according to one preferred embodiment of the present invention.
Figure 2:
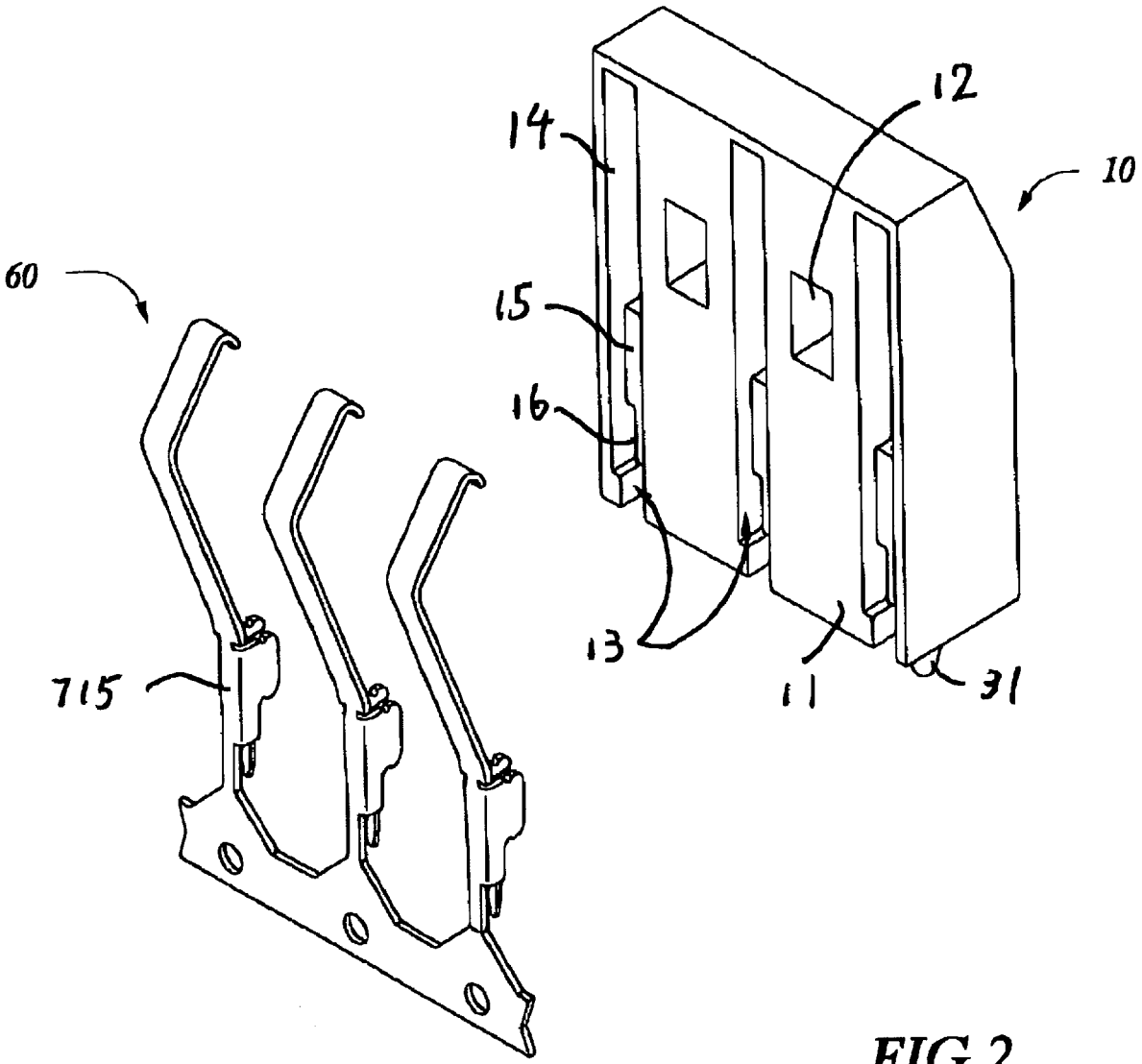
FIG. 2 is an exploded perspective view of the electrical connector shown in FIG. 1, wherein the conductive contacts are still connected to a carrier.

Referring now to FIGS. 1 and 2, FIG. 1 shows an assembled perspective view of an electrical connector for a power supply according to the present invention and FIG. 2 shows an exploded perspective view of the electrical connector. An electrical connector for a power supply mainly comprises an insulating main body 10 and a plurality of conductive contacts 60 received in the main body 10.

Referring now to FIGS. 1–4, the main body 10 comprises, on a front surface 11, a pair of rectangular recesses 12 for connection to a mating connector (not shown) and three slots 13 for receiving the conductive contacts 60 shown in FIG. 1. The number and the shape of the connecting recesses 12 and the receiving slots 13 may be changed, depending on particular applications of the electrical connector. Each of the receiving slots 13 comprises an elongate groove 14 and a channel 19 communicating the groove 14 to a bottom surface of the main body 10. The groove 14 comprises, a slant surface 21, an upper engagement surface 22 extending downward from the slant surface 21, and a raised portion 145 above the upper engagement surface 22. The raised portion 145 defines a pivoting surface 15 on an upper portion thereof facing outwardly. The raised portion 145 includes a retaining portion 16 on a lower portion thereof. The retaining portion 16 defines a single slit 17 on one lateral side and a pair of slits 18 on the other lateral side.

Figure 4:
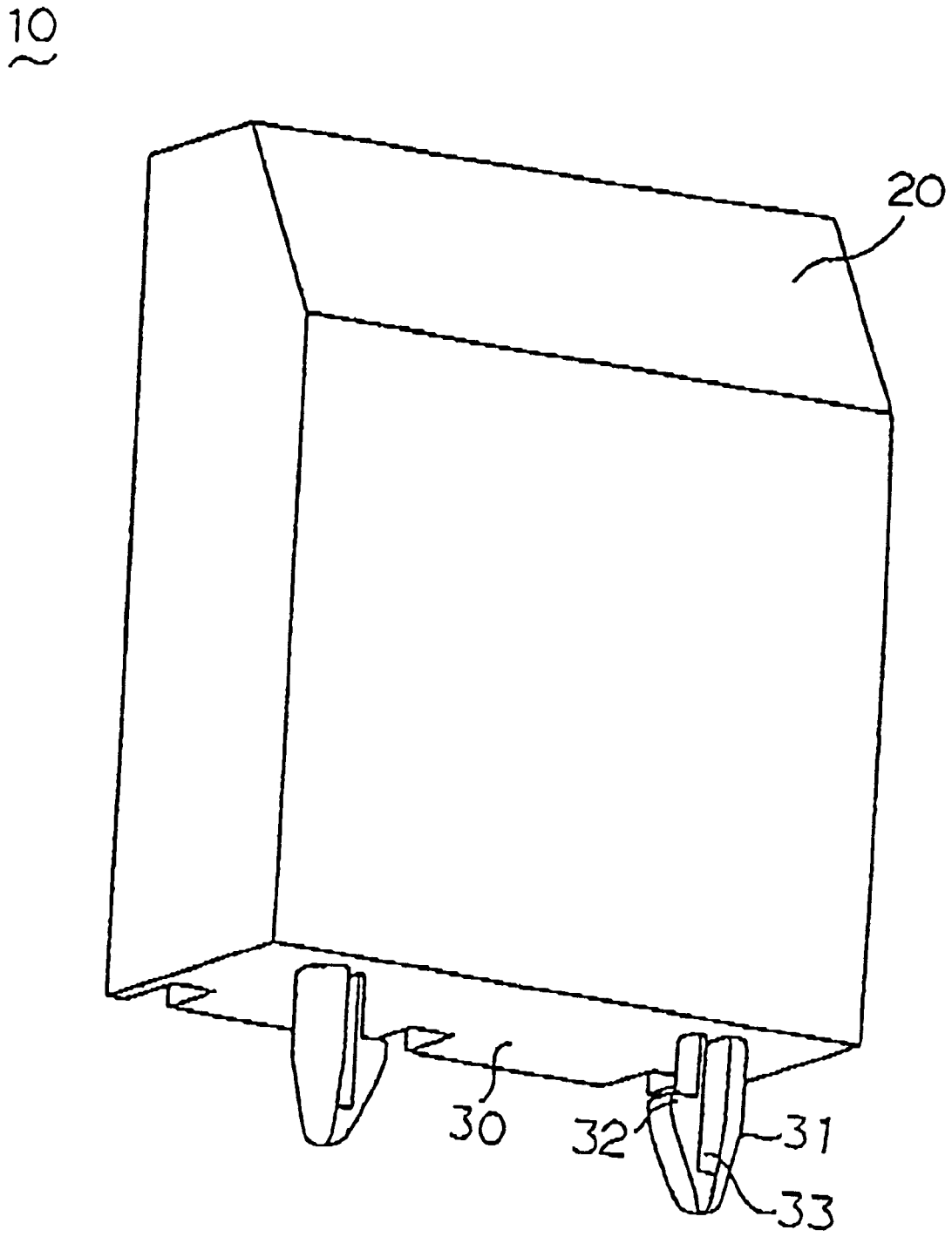
FIG. 4 is a rear perspective view of an insulating main body of the electrical connector shown in FIG. 1.
Figure 5:
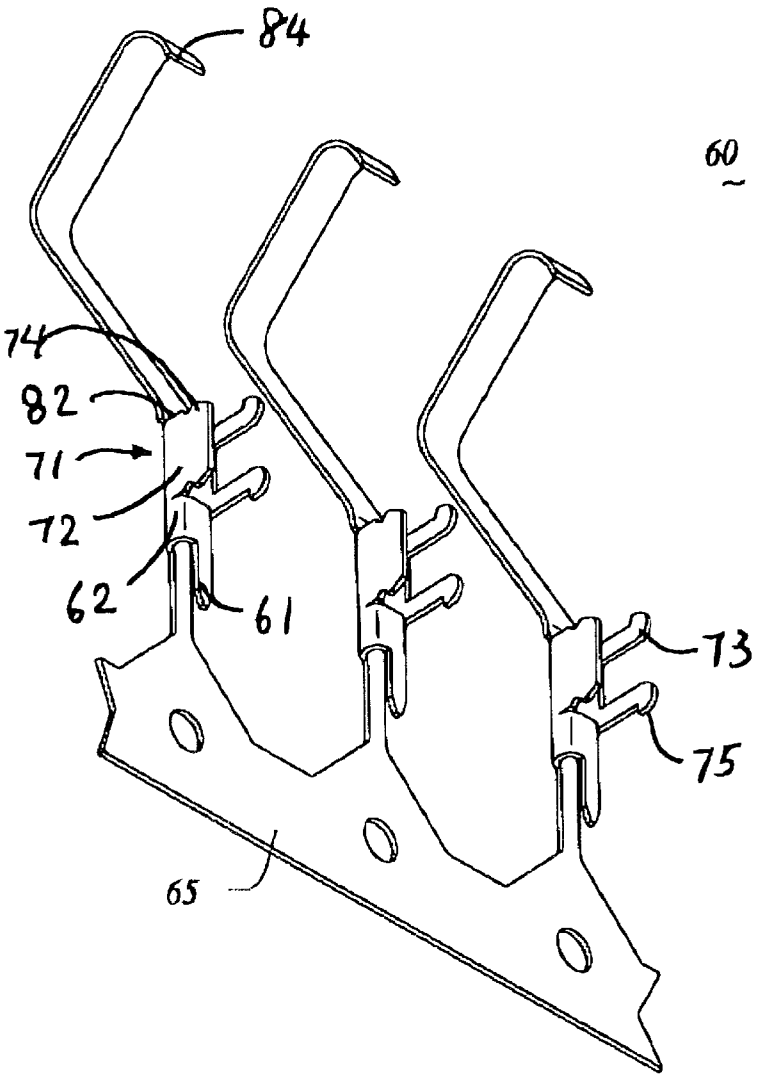
FIG. 5 is another perspective view of the conductive contacts shown in FIG. 2.

As can be seen in FIG. 4, the main body 10 may further comprise a pair of posts 31 projecting from a surface thereof, for example, the bottom surface 30, for fixing onto a printed circuit board. Preferably, the fixing posts 31 may be formed integrally with the main body 10. The fixing post 31 may include a latch portion 32 protruding laterally therefrom for securely fixing the connector to a printed circuit board. The fixing posts 31 may include an elongate aperture 33 formed along an axial portion thereof to provide a space for an inward movement of the latch portion 32 while a biasing force exerting thereon when the fixing posts 31 are inserted into a printed circuit board. Also, the main body 10 may have a top slant surface 20 on an upper rear portion, as can be best seen in FIG. 4, depending on particular applications of the electrical connector.

Referring now to FIGS. 1–5, the conductive contacts 60 are preferably made of a continuous metal strip and each of the conductive contacts 60 is formed as a unitary piece connected to a carrier 65. In assembling an electrical connector, a number of the contacts 60 may be inserted into the receiving slots 13 at the same time to simplify the assembling process.

Figure 6:
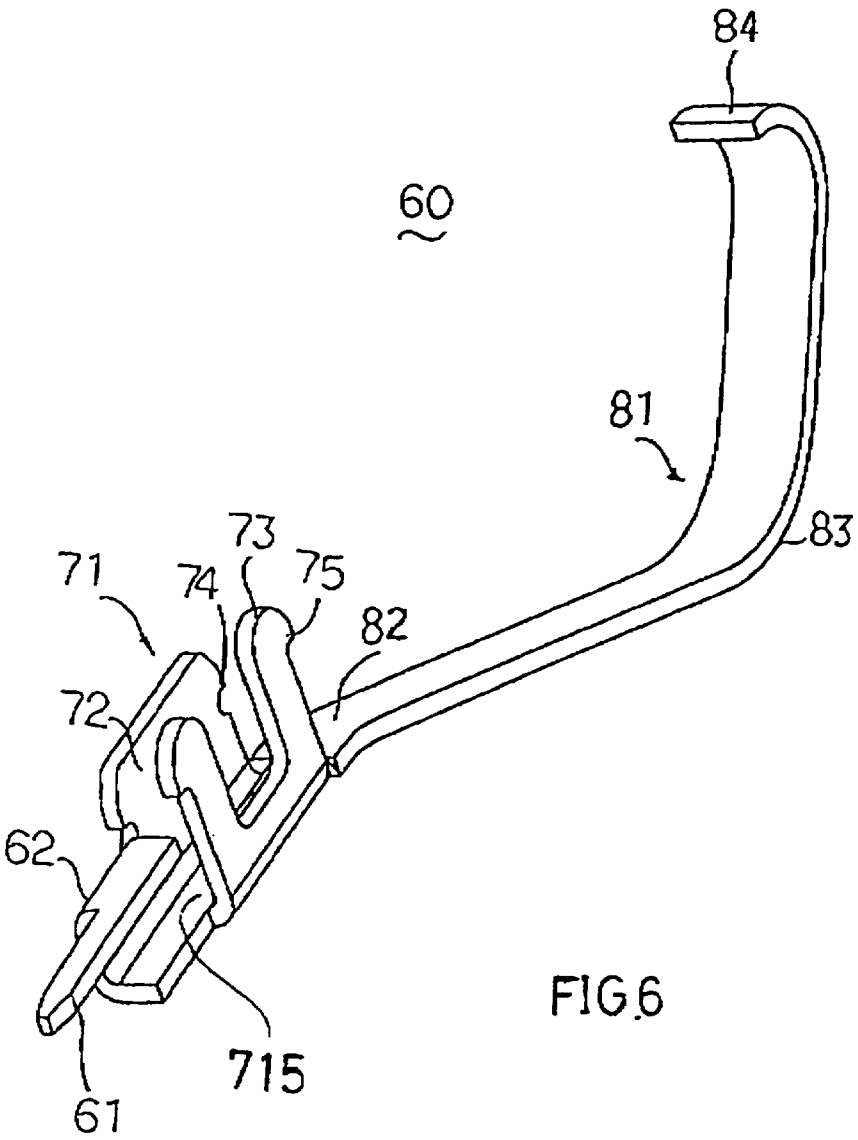
FIG. 6 is an enlarged perspective view of a conductive contacts according to the present invention.

Also referring to FIG. 6, the conductive contact 60 mainly comprises a retaining section 71, an inserting section 61, and a deflecting section 81. The retaining section 71 includes a single retention piece 72 on one lateral side and a pair of retention pieces 73 on the other lateral side. All of the retention pieces 72, 73 extend from a substantially flat, central portion 715 of the retaining section 71 and bend to a plane substantially perpendicular to a plane defined by the central portion 715. The retention pieces 72, 73 may include barbs 74, 75 thereon to enhance its retaining ability to the main body 10 shown in FIG. 1. In one embodiment, the single retention piece 72 may have a pair of barbs 74 on its upper and lower edges, respectively, and each of the pair of retention pieces 73 may have a single barb 75 on a remote edge relative to each other.

The inserting section 61 extends downward from a transition section 62 extending from the retaining section 71 and is formed as a terminal insert for connection to an external circuit. In one embodiment, the transition section 62 is a U-shaped piece substantially connected at one U-shaped end thereof to the central portion 715 of the retaining section 71 and connected at the other U-shaped end thereof to the inserting section 61, as can be best seen in FIG. 5.

The deflecting section 81 includes a pivoting portion 82 extending from the retaining section 71, an arcuate engagement portion 83 extending from the pivoting portion 82, and a supporting portion 84 extending from the engagement portion 83. Because of the resilient property of the metal used for the contact 60, the deflection section 81 deforms when an external force exerts thereon and recovers to its original shape after the external force removes.

Figure 3:
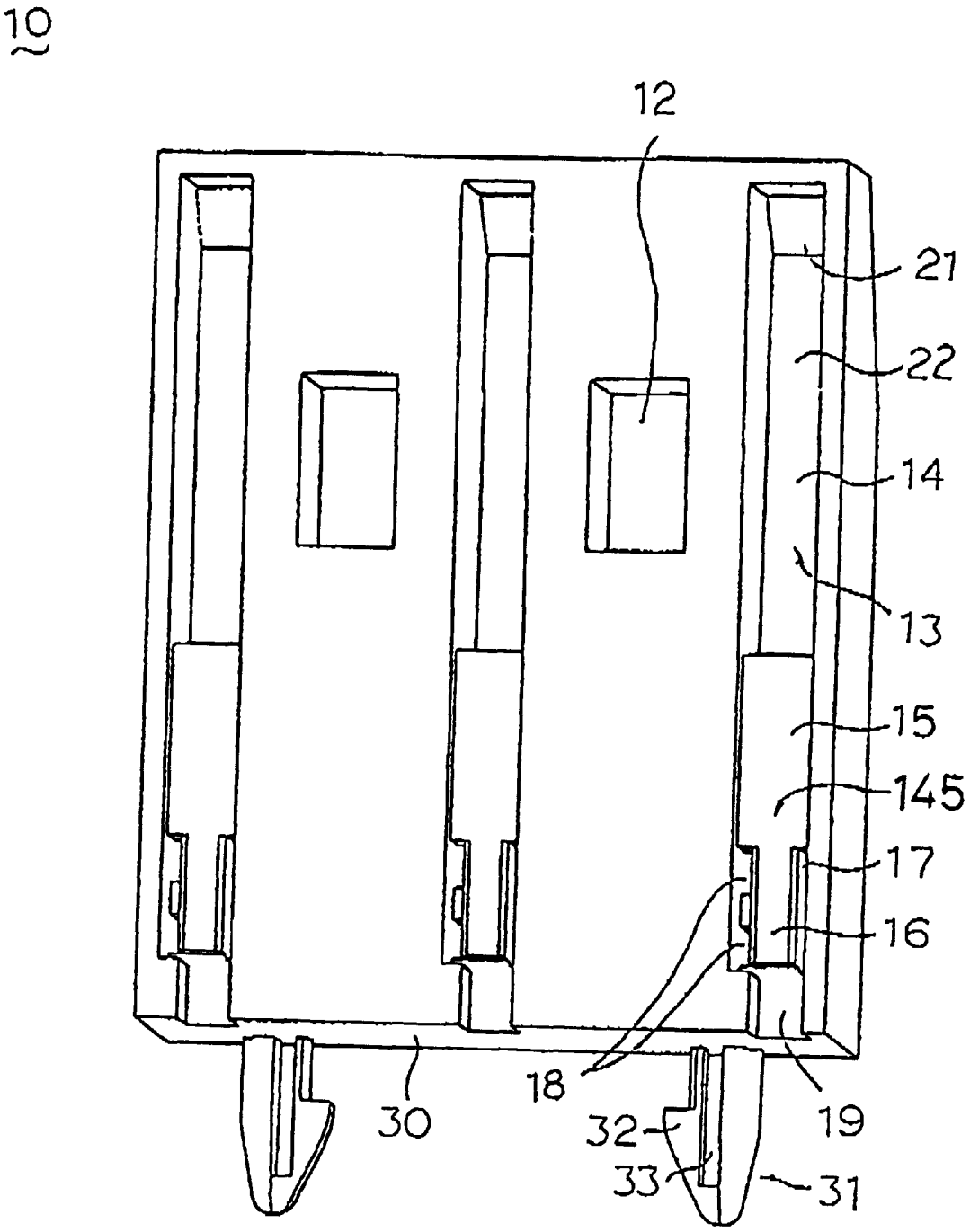
FIG. 3 is a front perspective view of an insulating body of the electrical connector shown in FIG. 1.

When assembling the conductive contact 60 into the main body 10 in reference to FIGS. 3 & 6, the retaining section 71 is attached to the retaining portion 16 of the main body by inserting the retention pieces 72, 73 into the corresponding slits 17, 18. Because of the interference fit of the retention pieces 72, 73 with the slits 17, 18, respectively, the contacts 60 can be firmly secured to the main body 10. After assembling, the inserting section 61 of the contact 60 extends out off the main body 10 through the channel 19, and the arcuate engagement portion 83 of the contact 60 deflects convexly out off the groove 14, and thus off the front surface 11, of the main body 10. In addition, the pivoting portion 82 abuts to the lower engagement surface 15 of the raised portion 145, and the supporting portion 84 hangs in the air and does not touch the supporting surface 22 of the groove 14.

Figure 7:
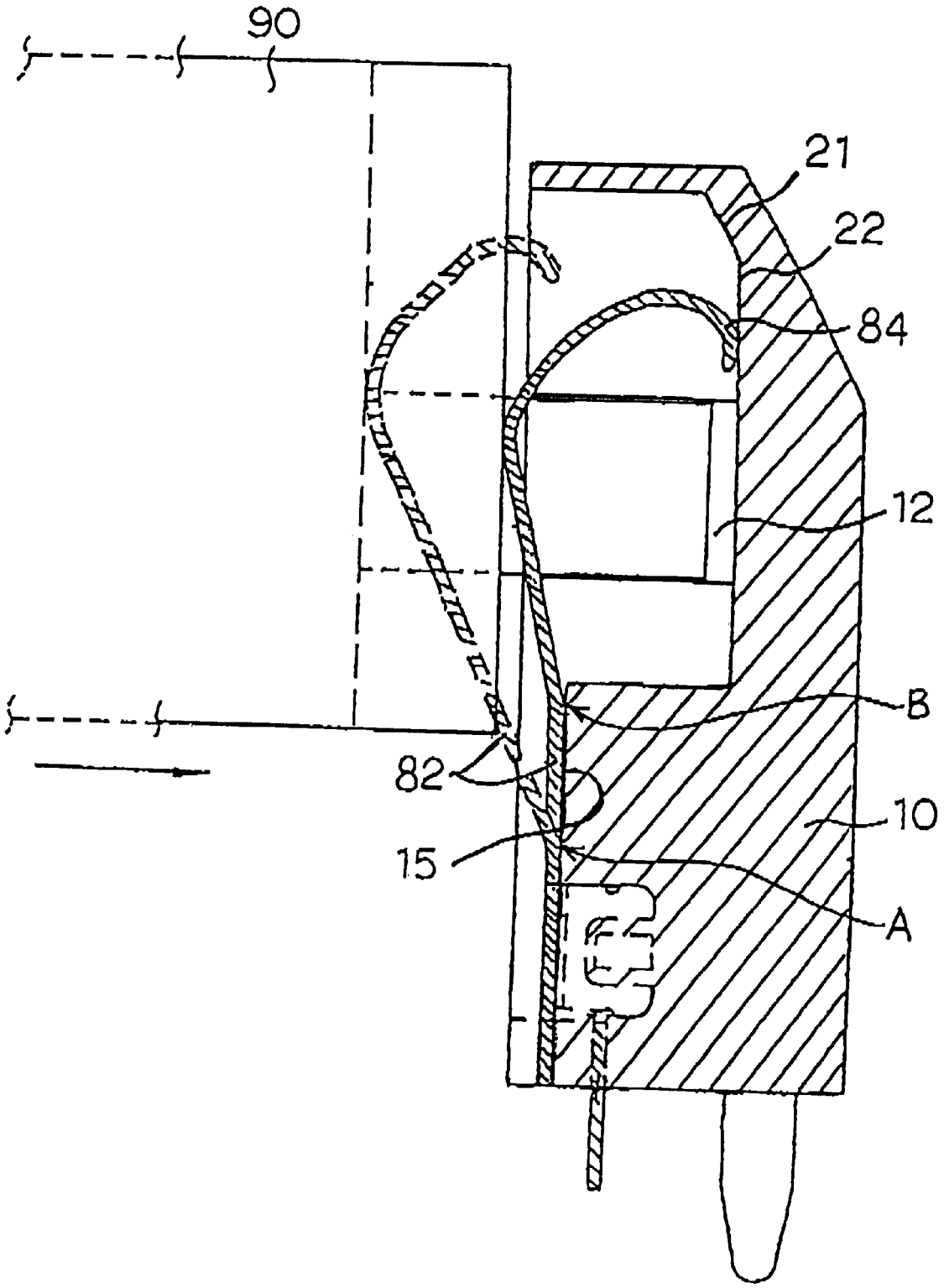
FIG. 7 is a side view of the electrical connector according to the present invention when using with a mating connector for a battery.

Referring to FIG. 7, an the present electrical connector according to the present invention is in use with a mating connector 90 for a battery. When the arcuate engagement portion 82 does not engage with the connector 90, the deflecting section 81 acts as a cantilevered beam pivoting at the pivoting portion 82. When the arcuate engagement portion 82 engages with the connector 90, the arcuate engagement portion 83 of the deflecting section 81 is pressed by a counterpart on the connector 90 and the deflecting section 81 moves backward and pivots around the pivoting portion 82, and the supporting portion 84 moves gradually toward and finally butts the upper engagement surface 22. Meanwhile, a moment arm of the deflection section 81 defined between the pivoting point and the engaging point will change in length together with the backward movement of the deflection section 81 due to the flexibility of the material composing the contacts 60 and due to the change of the pivoting point on the engaging point.

The engagement of the deflecting section 81 with the connector 90 can be separated into two stage: a first stage when the supporting portion 84 does not abut to the upper engagement surface 22, and a second stage when the supporting portion 84 abuts the upper engagement surface 22.

During the first stage of engagement, the deflecting section 81 acts as a cantilevered beam pivoting at the pivoting portion 82, and thus the engaging normal force provided by the arcuate engagement portion 83 increases slowly because the pivoting point between the pivoting portion 82 and the pivoting surface 15 moves from a lower point A, as shown in phantom in FIG. 7, to an upper point B.

During the second stage of engagement, the deflecting section 81 acts as a simple beam supported at point B and at the abutting point between the supporting portion 84 and the supporting surface 22, and thus the engaging normal force provided by the arcuate engagement portion 83 increases fast because the deflecting section 81 is supported at both ends and the arc shape of the arcuate engagement portion 83 may provide a large supporting force.

The supporting portion 84 of the deflection section 81 may include a hook tip portion so that the supporting portion 84 will not abut by its tip edge to the supporting surface 22, but rather by an end surface thereto to reduce the sliding friction between the supporting portion 84 and the supporting surface 22.

While the present invention has been described with reference to specific embodiments, the description is illustrative of the present invention and is not to be construed as limiting the present invention. Various modifications to the present invention can be made to the preferred embodiment by those skilled in the art without departing from the sprits and scope of the invention as defined by the appended claims.

It is claimed that:

1. An electrical connector for an energy supply, comprising:

an insulating main body having a plurality of grooves on a first outermost surface thereof and a pivoting surface defined on a raised portion of each of the grooves; and a plurality of conductive contacts received in the grooves, each of said conductive contacts having a pivoting portion in pivotally abutting on the pivoting surface of the raised portion in the corresponding groove in stages with at least two different pivotal points between the pivoting portion of the same contact and the pivoting surface thereby varying a moment arm of the same contact in length in engagement with the energy supply, having an end extending out off a second outermost surface of the main body.

2. The electrical connector for an energy supply as claimed in claim 1, wherein each of the grooves comprises a supporting surface adjacent to the raised portion for supporting a supporting portion of said conductive contact while said electrical connector being connected to a mating connector, and the raised portion comprises a retaining portion remote from the supporting surface having a first slit on one lateral side and a pair of spaced second slits on the other lateral side thereof for securing the contact to the groove.

3. The electrical connector for an energy supply as claimed in claim 2, wherein each of the conductive contacts comprises an inserting section for inserting into a printed circuit board, a deflecting section for engaging with a mating connector, and a retaining section between the inserting section and the deflecting section, said retaining section having a first retention piece on one lateral side and a pair of spaced second retention pieces on the other lateral side thereof, said first and second retention pieces being inserted into said and second slits of the retaining portion respectively, and each of said retention pieces having at least one barb in interference fit with the slits of the retaining portion.

4. The electrical connector for an energy supply as claimed in claim 3, wherein said deflecting section of the conductive contacts comprises an arcuate engagement portion extending from the pivoting portion for engaging with a mating connector, and a supporting portion for abutting the supporting surface of the groove.

5. The electrical connector for an energy supply as claimed in claim 1, further comprises a pair of fixing posts projecting from the second outmost surface of the main body, each fixing post having a latch portion for fixing onto a printed circuit board.

6. The electrical connector for an energy supply as claimed in claim 5, wherein each of said fixing posts is integrally formed on the main body and has an elongate aperture formed therein offsetting from an axis of the fixing post to a lateral side of the fixing post having the latch portion.

7. A connector adapted to be mated with another complementary connector, comprising:

an insulating main body having a front outmost surface and a plurality of grooves defined on said front outmost surface for receiving a corresponding number of contacts therein;

the groove defining a pivoting surface being lower than the front outmost surface, and an engagement surface being lower than the pivoting surface;

each of said contacts including a deflecting section which is defined with a pivoting portion, an engagement portion and a supporting portion thereon, and adapted to be installed into the corresponding groove from the front outmost surface; wherein said pivoting portion is spaced apart from the pivoting surface, said engagement portion is spaced from the front outmost surface, and the supporting portion is spaced from the engagement surface thereby facilitating the deflecting section of the same contact to be a cantilevered beam when the connector is in an unmated condition; and said pivoting portion abuts against the pivoting surface, said engagement portion is generally flush with the front outmost surface, and the supporting portion abuts against the engagement surface thereby facilitating the deflecting section of the same contact to be a simple beam different from said cantilevered beam in the length when the connector is in a mated condition whereby the pivoting portion pivotally abuts on the pivoting surface in the corresponding groove in stages by at least two different pivotal points therebetween thereby varying the moment arm of the same contact in length in engagement with the complementary connector.

8. The connector as defined in claim 7, wherein the main body further defines a bottom outmost surface, and each of said contacts further includes an insertion section extending out of the bottom outmost surface through a channel communicating the groove to the bottom outmost surface.

9. A connector for an energy supply, comprising:

an insulative main body having a front outmost surface and a plurality of grooves defined on said front outmost surface for receiving a corresponding number of contacts therein;

the groove being open to the front outmost surface and defining a pivoting surface therein which is lower than the front outmost surface;

each of said contacts including at least a pivoting portion, and a retaining section perpendicular thereto and receivably secured within the corresponding groove by means of being positioned around the pivoting surface, defined with a first retention piece having a first barbs means, and a pair of spaced and aligned second retention pieces each which form a second barbs means on a remote edge relative to each other thereby enhancing the retention of the same contacts to the main body wherein the pivoting portion pivotally abuts on the pivoting surface in the corresponding groove in stages by at least two different pivotal points therebetween thereby varying the moment arm of the same contact in length in engagement with the energy supply.

10. The connector as defined in claim 9, wherein the main body further includes a bottom surface, and a channel is formed around each groove to communicate with said bottom surface, and each of the contacts further includes an inserting section integrally downward from the retaining section, so as to extend out of the bottom surface through said channel.

* * * * *